US008680999B2

(12) United States Patent
Wood

(10) Patent No.: US 8,680,999 B2
(45) Date of Patent: Mar. 25, 2014

(54) LOSS PREVENTION SYSTEM

(75) Inventor: Robert J. Wood, Syracuse, NY (US)

(73) Assignee: Welch Allyn, Inc., Skaneateles Falls, NY (US)

( * ) Notice: Subject to any disclaimer, the term of this patent is extended or adjusted under 35 U.S.C. 154(b) by 144 days.

(21) Appl. No.: 13/298,356

(22) Filed: Nov. 17, 2011

(65) Prior Publication Data

US 2012/0146793 A1 Jun. 14, 2012

Related U.S. Application Data

(60) Provisional application No. 61/422,426, filed on Dec. 13, 2010.

(51) Int. Cl.
*G08B 13/14* (2006.01)

(52) U.S. Cl.
USPC ..... 340/568.1; 340/571; 340/686.6

(58) Field of Classification Search
USPC ..... 340/568.1, 571, 686.6
See application file for complete search history.

(56) References Cited

U.S. PATENT DOCUMENTS

| | | | | |
|---|---|---|---|---|
| 4,709,330 | A | 11/1987 | Yokoi et al. | |
| 5,801,627 | A * | 9/1998 | Hartung | 340/568.1 |
| 5,963,131 | A | 10/1999 | D'Angelo et al. | |
| 6,011,473 | A | 1/2000 | Klein | |
| 6,075,443 | A | 6/2000 | Schepps et al. | |
| 7,009,516 | B2 | 3/2006 | Enea | |
| 7,471,203 | B2 | 12/2008 | Worthy et al. | |
| 7,535,357 | B2 | 5/2009 | Enitan et al. | |
| 7,696,871 | B2 | 4/2010 | Villiger | |
| 7,864,049 | B2 * | 1/2011 | Scott et al. | 340/571 |
| 8,378,823 | B2 * | 2/2013 | Eckert et al. | 340/571 |
| 8,477,032 | B2 * | 7/2013 | Bergman et al. | 340/568.5 |
| 2003/0189488 | A1 | 10/2003 | Forcier et al. | |
| 2005/0148339 | A1 | 7/2005 | Boman et al. | |
| 2005/0285739 | A1 | 12/2005 | Velhal et al. | |
| 2007/0186923 | A1 | 8/2007 | Poutiatine et al. | |
| 2007/0229258 | A1 | 10/2007 | Villiger | |
| 2009/0273485 | A1 | 11/2009 | Wike | |

FOREIGN PATENT DOCUMENTS

| | | | |
|---|---|---|---|
| CA | 2331702 | A1 | 9/2000 |
| JP | 2002507036 | A | 3/2002 |
| KR | 1020010071222 | A | 7/2001 |
| WO | 2009124108 | A1 | 10/2009 |

OTHER PUBLICATIONS

International Search Report and Written Opinion in PCT/US2011/06119 mailed May 18, 2012, 8 pages.
Akass, Nio Portable Alarm, Sep. 17, 2009.
Vila, Infrared Protection System, Journal: Revista Espanola de Electronica, vol. 32, No. 367, p. 36-9, Spain, Jun. 1985.
Yang et al., EagleVision: A Pervasive Mobile Device Protection System, Iowa State Univ., Ames, IA, Jul. 2009.

* cited by examiner

*Primary Examiner* — Toan N Pham
(74) *Attorney, Agent, or Firm* — Merchant & Gould P.C.

(57) ABSTRACT

A loss prevention system comprises a protected article and a receiver. The protected article and the receiver are located in the same room. The loss prevention system can help to prevent loss or theft of the protected article. The protected article comprises a transmitter that emits an infrared signal. The infrared signal has a carrier frequency that is modulated to encode a digital signature. The receiver detects infrared signals. The receiver performs an alarm action if the receiver does not detect within a rolling time window an infrared signal having the carrier frequency that is modulated to encode the digital signature.

18 Claims, 4 Drawing Sheets

LOSS PREVENTION SYSTEM

RELATED APPLICATION

This application claims the benefit of U.S. Patent Application Ser. No. 61/422,426 filed on Dec. 13, 2010, the entirety of which is hereby incorporated by reference.

BACKGROUND

Businesses frequently possess small valuable articles that are intended to remain in a single room for indefinite periods of time. For example, a doctor's office may keep a digital thermometer in an exam room. Unfortunately, it can be relatively easy for such articles to be lost. Such articles can be lost in various ways. For example, small valuable articles can be stolen or misplaced. For example, a person could steal a digital thermometer simply by putting the digital thermometer in a pocket and walking out of an exam room where the digital thermometer is meant to stay. In another example, a digital thermometer could easily become concealed in the bed linens of a patient's hospital room and be accidentally taken out of the hospital room when the bed linens are changed.

SUMMARY

A loss prevention system is provided. The theft and loss prevention system comprises a protected article and a receiver. The protected article and the receiver are located in the same room. The protected article comprises a transmitter that emits an infrared signal. The infrared signal has a carrier frequency that is modulated to encode a digital signature. The receiver detects infrared signals. The receiver performs an alarm action if the receiver does not detect within a rolling time window an infrared signal having the carrier frequency that is modulated to encode the digital signature.

DETAILED DESCRIPTION

Figure 1:
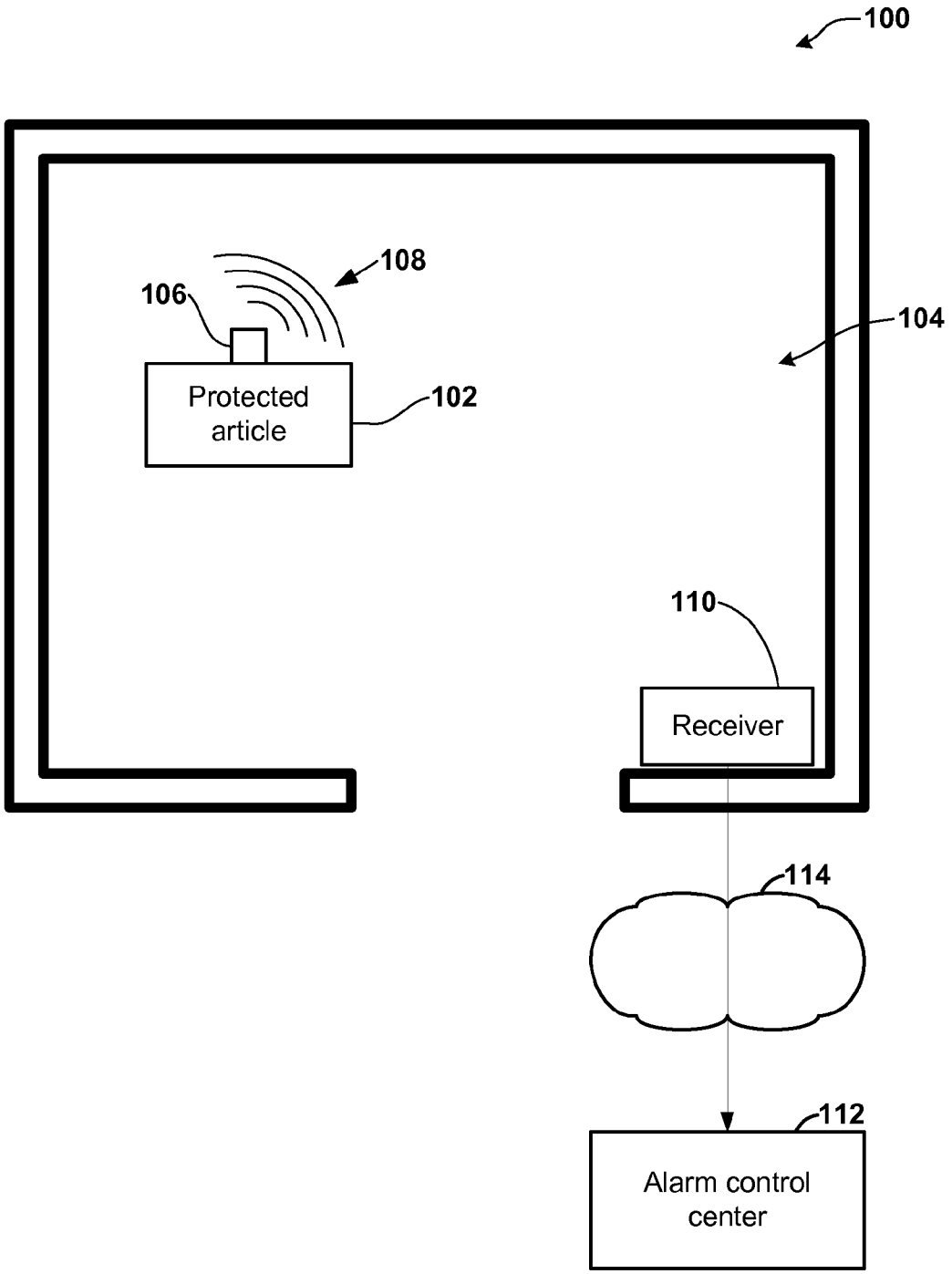
FIG. 1 illustrates an example embodiment of a loss prevention system.

FIG. 1 illustrates an example embodiment of a loss prevention system 100. As illustrated in the example of FIG. 1, the loss prevention system 100 comprises a protected article 102. The protected article 102 can be a wide variety of different types of articles. For example, the protected article 102 can be a portable medical device, such as a digital thermometer, a digital otoscope, a vital signs reader, a patient monitor, a set of surgical equipment, a set of dental tools, or another type of portable medical device. In another example, the protected article 102 can be a personal computer, a laptop computer, a tablet computer, a handheld computer, a computer peripheral device, a printer, a projector, a camera, a book, a safe, a tool, or another type of article.

The protected article 102 is located in a room 104. The room 104 can be a variety of different types of room. For example, the room 104 can be a medical exam room, an operating room, a recovery room, an observation room, and/ or an intensive care unit room. In another example, the room 104 can be an office, a conference room, a hotel room, a bathroom, a workshop, a shed, or another type of room. The room 104 can be located inside a building.

The protected article 102 comprises a transmitter 106. The transmitter 106 periodically emits an infrared signal 108. The infrared signal 108 has a carrier frequency. In various embodiments, the infrared signal 108 has various carrier frequencies. For example, the infrared signal 108 can have a carrier frequency of 20 kHz.

The transmitter 106 modulates the carrier frequency of the infrared signal 108 to encode a digital signature into the infrared signal 108. In this way, the infrared signal 108 carries the digital signature. The digital signature is a series of digits. In various embodiments, the digital signature can contain various numbers of digits. For example, the digital signature can be a series of 32 binary digits. In another example, the digital signature can be a series of 10 decimal digits.

The loss prevention system 100 also comprises a receiver 110. The receiver 110 is mounted at a fixed position within the room 104. The receiver 110 detects infrared signals, such as the infrared signal 108. Because the infrared signal 108 is in the infrared part of the electromagnetic spectrum, the infrared signal 108 does not significantly penetrate the walls of the room 104. Consequently, infrared detectors located outside the room 104 do not receive the infrared signal 108. However, the infrared signal 108 tends to reflect off the walls of the room 104. As a result, the receiver 110 can detect the infrared signal 108 even if there is not a direct line of sight between the protected article 102 and the receiver 110.

The receiver 110 stores one or more digital signatures. For example, the receiver 110 can store the digital signature of the transmitter 106. Each of the digital signatures is associated with a time window. In various embodiments, the timer windows have various lengths. For example, the timer windows can have lengths of ten seconds. In another example, the timer windows can have lengths of twenty seconds. When the receiver 110 detects an infrared signal having the carrier frequency, the receiver 110 determines whether the infrared signal carries one of the digital signatures. If the receiver 110 determines that the infrared signal carries one of the digital signatures, the receiver 110 resets a time window for the digital signature.

The receiver 110 performs an alarm action if the receiver 110 does not detect an infrared signal that carries the digital signature within the time window for the digital signal. For example, the time window for a given digital signature can be ten seconds. In this example, the receiver 110 performs an alarm action if the receiver 110 does not receive an infrared signal that carries the given digital signature within ten seconds of a most recent time that the receiver 110 received an infrared signal that carried the given digital signature.

In various embodiments, the receiver 110 can perform various alarm actions. For example, performing the alarm action can comprise emitting an audible alarm, such as a siren. In another example, performing the alarm action can comprise flashing a light. In the example of FIG. 1, the loss prevention system 100 comprises an alarm control center 112. In the example of FIG. 1, performing the alarm action comprises sending an alarm signal from the receiver 110 to the alarm control center 112 via a communications network 114.

The alarm control center 112 comprises one or more physical locations where people and/or computing devices receive alarm signals and determine how to respond to the alarm signals. In different embodiments, the alarm control center 112 can be in a different building than the room 104 or the same building as the room 104. The alarm control center 112 can be operated by an entity that uses the room 104 or by a third party service provider. The communications network 114 can comprise various types of communications networks, such as a public-switched telephone network, a wireless computer networking network, a wired broadband network connection, the Internet, a local-area network, or another type of communications network.

Figure 2:
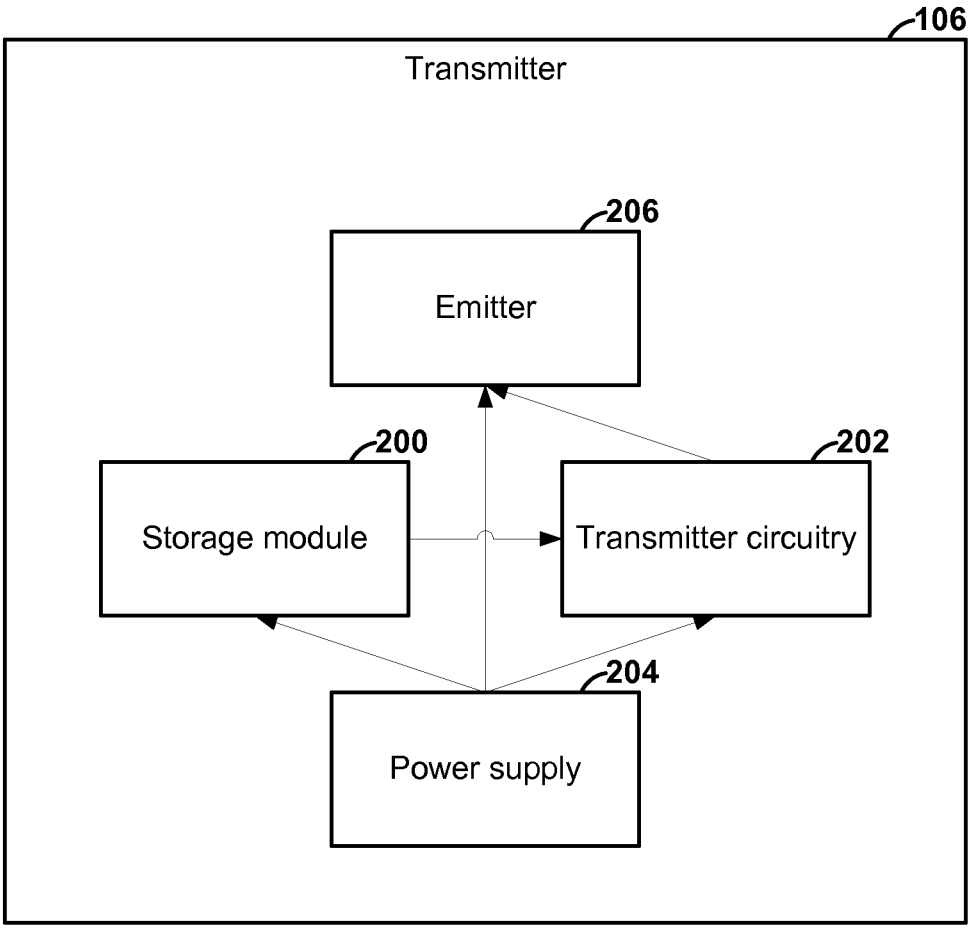
FIG. 2 is a block diagram that illustrates example details of a transmitter in the loss prevention system.

FIG. 2 is a block diagram that illustrates example details of the transmitter 106 in the loss prevention system 100. In various embodiments, the protected article 102 may or may not be designed for use with the transmitter 106. For example, the protected article 102 can be originally designed and manufactured to include the transmitter 106. In another example, the protected article 102 can be originally designed to be used with the transmitter 106 and the transmitter 106 is added to the protected article 102 after the protected article 102 is initially sold. In yet another example, the protected article 102 is not originally designed to be used with the transmitter 106.

In various embodiments, the transmitter 106 can be attached to the protected article 102 in various ways. For example, the transmitter 106 can be incorporated within an exterior housing of the protected article 102. In another example, the transmitter 106 can be attached to an exterior of the protected article 102 with an adhesive, screws, bolts, rivets, welds, tape, or other fasteners.

As illustrated in the example of FIG. 2, the transmitter 106 comprises a storage module 200, transmitter circuitry 202, a power supply 204, and an emitter 206. The storage module 200 stores a digital signature. In various embodiments, the digital signature can become stored in the storage module 200 in various ways. For example, the digital signature can be hard coded into the circuitry in the storage module 200. In another example, the storage module 200 is an electrically-erasable programmable read-only memory (EEPROM). In this example, the digital signature can be stored onto the storage module 200 when the transmitter 106 is manufactured, or afterward. In some embodiments where the digital signature is stored onto the storage module 200 when the transmitter is manufactured, each different transmitter made by a given manufacturer stores a unique digital signature. In other embodiments where the digital signature is stored onto the storage module 200 when the transmitter is manufactured, transmitters for different product types have different digital signatures, but transmitters for the same product type have the same digital signature. In another example, an end user of the protected article 102 can store the digital signature on the storage module 200.

The transmitter circuitry 202 retrieves the digital signature from the storage module 200 and outputs electrical signals to the emitter 206. The electrical signals cause the emitter 206 to emit the infrared signal 108. In some embodiments, the emitter 206 emits the infrared signal 108 in all directions. In other embodiments, the emitter 206 emits the infrared signal 108 in only some directions. As discussed above, the infrared signal 108 has a carrier frequency that is modulated to encode the digital signature stored in the storage module 200.

In various embodiments, the transmitter circuitry 202 outputs electrical signals that cause the emitter 206 to emit the infrared signal 108 at various intervals. For example, the transmitter circuitry 202 can cause the emitter 206 to emit the infrared signal 108 once every second. In another example, the transmitter circuitry 202 can cause the emitter 206 to emit the infrared signal 108 once every three seconds.

The power supply 204 provides electrical power to the storage module 200, the transmitter circuitry 202, and the emitter 206. In various embodiments, the power supply 204 is implemented in various ways. For example, the power supply 204 can be implemented as a rechargeable battery. In this example, the rechargeable battery can be separate from the main power supply of the protected article 102. In another example, the power supply 204 can be the main power supply of the protected article 102. The main power supply of the protected article 102 can be a battery or a main power supply of a building that contains the room 104.

Figure 3:
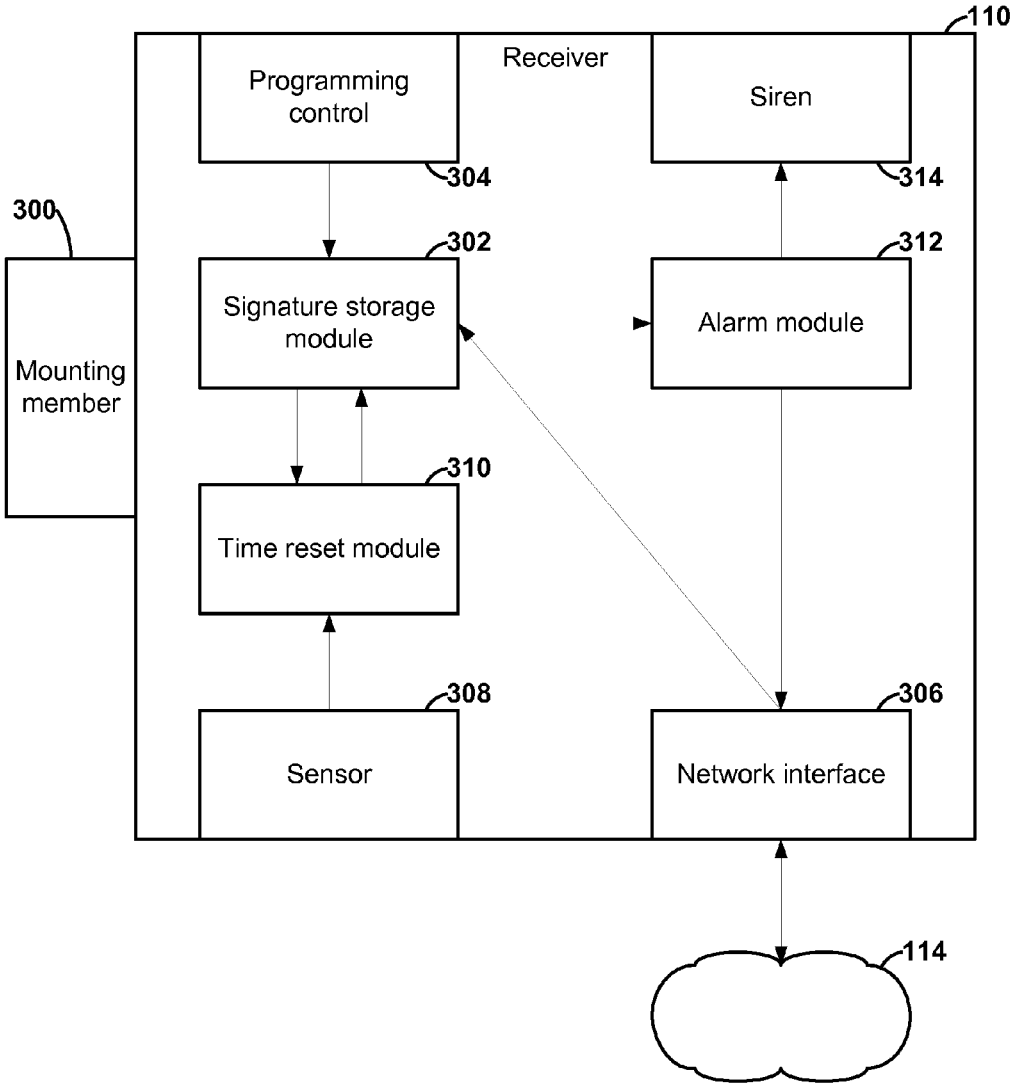
FIG. 3 is a block diagram that illustrates example details of a receiver in the loss prevention system.

FIG. 3 is a block diagram illustrating example details of a receiver 110. As illustrated in the example of FIG. 3, the receiver 110 has a mounting member 300. The mounting member 300 acts to mount the receiver 110 at a stationary location within the room 104. In various embodiments, the mounting member 300 can have various forms. For example, the mounting member 300 can be a bracket that mounts the receiver 110 to a wall of the room 104. In another example, the mounting member 300 can be a portion of an exterior housing of the receiver 110 that defines a loop through which a screw, nail, or other fastener can pass. This fastener is attached to a wall or other surface in the room 104. In yet another example, the mounting member 300 is a flat area in the exterior housing of the receiver 110. In this example, the flat area of the external housing can help the receiver 110 rest stably on a flat surface within the room 104.

Furthermore, the receiver 110 comprises a signature storage module 302. The signature storage module 302 stores one or more digital signatures. In various embodiments, the signature storage module 302 is implemented in various ways. For example, the signature storage module 302 can be implemented as an EEPROM, a solid state memory module (e.g., a Flash memory unit), or another type of computer-readable storage medium.

In various embodiments, the digital signatures can be stored onto the signature storage module 302 in various ways. For example, the receiver 110 can comprise a programming control 304 as shown in FIG. 3. When a user of the receiver 110 activates the programming control 304, the signature storage module 302 stores the digital signatures carried by each infrared signal detected by the receiver 110 within a given time period. Thus, when the user installs the receiver 110 in the room 104, the user can activate the programming control 304 to cause the receiver 110 to start expecting to detect infrared signals carrying the digital signatures of each protected article in the room 104.

In various embodiments, the user can activate the programming control 304 in various ways. For example, the programming control 304 can be a button. In this example, the user activates the programming control 304 by pressing on the programming control 304. In another example, the programming control 304 can be a switch. In this example, the user activates the programming control 304 when the user flips the switch.

In another example, the receiver 110 can comprise a network interface 306 as shown in FIG. 3. The network interface 306 is a device that enables the receiver 110 to communicate with other computing devices via the communications network 114. In this example, the network interface 306 receives digital signatures from another computing device via the communications network 114. For instance, the network interface 306 can receive the digital signatures from a computing device at the alarm control center 112. When the network interface 306 receives a digital signature, the signature storage module 302 stores the digital signature.

In other embodiments, digital signatures can be stored onto the signature storage module 302 in other ways. For example, the receiver 110 can comprise a keypad (not shown). In this example, the signature storage module 302 stores digital signatures entered by a user via the keypad.

The signature storage module 302 also stores time data associated with each of the digital signatures stored in the signature storage module 302. In various embodiments, the time data have various forms. For example, the time data associated with a digital signature can indicate a last time that the receiver 110 detected an infrared signal that carries the digital signature. In another example, the time data associated with a digital signature indicates a time before which the receiver 110 must receive an infrared signal carrying the digital signature to prevent the receiver 110 from performing an alarm action. In yet another example, the time data associated with a digital signature can count up the amount of time that has passed after the receiver 110 last received an infrared signal carrying the digital signature.

Furthermore, the receiver 110 comprises a sensor 308. The sensor 308 detects infrared signals, such as the infrared signal 108. When the sensor 308 detects an infrared signal, the sensor 308 outputs an electrical signal to a time reset module 310 within the receiver 110. In various embodiments, the electrical signal encodes different information about the infrared signal. For example, the electrical signal outputted by the sensor 308 can have a voltage waveform that represents the modulated carrier frequency of the infrared signal. In another example, the sensor 308 can demodulate the carrier frequency. In this example, the electrical signal outputted by the sensor 308 can have a voltage waveform that represents information modulated onto the carrier frequency.

The time reset module 310 determines whether the information carried by the detected infrared signal (i.e., the information modulated onto the carrier frequency of the infrared signal) is one of the digital signatures stored in the signature storage module 302. To determine whether the information carried by the detected infrared signal is one of the digital signatures stored in the signature storage module 302, the time reset module 310 reads the digital signatures from the signature storage module 302.

If the time reset module 310 determines that the information carried by the detected infrared signal is a given one of the stored digital signatures, the time reset module 310 resets the time window associated with the given digital signature. In various embodiments, the time reset module 310 resets the time window associated with the given digital signature in various ways. For example, the time reset module 310 can store time data indicating a current time into the signature storage module 302. In another example, the time reset module 310 can store time data that indicates a time before which the receiver 110 must receive an infrared signal carrying the digital signature to prevent the receiver 110 from performing an alarm action.

The receiver 110 also comprises an alarm module 312. The alarm module 312 determines whether the receiver 110 has detected infrared signals carrying the stored digital signatures within the time windows for the stored digital signatures. In various embodiments, the alarm module 312 determines in various ways whether the receiver 110 has detected an infrared signal carrying a given one of the digital signatures within a time window for the given digital signature. For example, the signature storage module 302 can store a time data that indicates a last time that the receiver 110 detected an infrared signal carrying the given digital signature. In this example, the alarm module 312 determines whether an amount of time between the current time and the time indicated by the time data is greater than the time window for the given digital signature. In another example, the signature storage module 302 can store time data that indicates a time before which the receiver 110 must detect another infrared signal carrying the digital signature. In this example, the alarm module 312 determines whether a current time is after the time indicated by the time data.

If the alarm module 312 determines that the receiver 110 has not detected an infrared signal carrying a given one of the stored digital signatures within the time window for the given digital signature, the alarm module 312 performs an alarm action. In various embodiments, the alarm module 312 can perform various alarm actions. For instance, in the example of FIG. 3, the receiver 110 comprises a siren 314. When the alarm module 312 performs an alarm action, the alarm module 312 can output electrical signals that cause the siren 314 to emit an audible sound. Furthermore, when the alarm module 312 performs an alarm action, the alarm module 312 can cause the network interface 306 to send an alarm message to a computing device in the alarm control center 112 via the communications network 114.

The time reset module 310, the alarm module 312, and the network interface 306 can be implemented in various ways. For example, the time reset module 310, the alarm module 312, and/or the network interface 306 can be comprise one or more integrated circuits. In another example, the time reset module 310, the alarm module 312, and/or the network interface 306 can comprise one or more circuits laid out on a circuit board.

Figure 4:
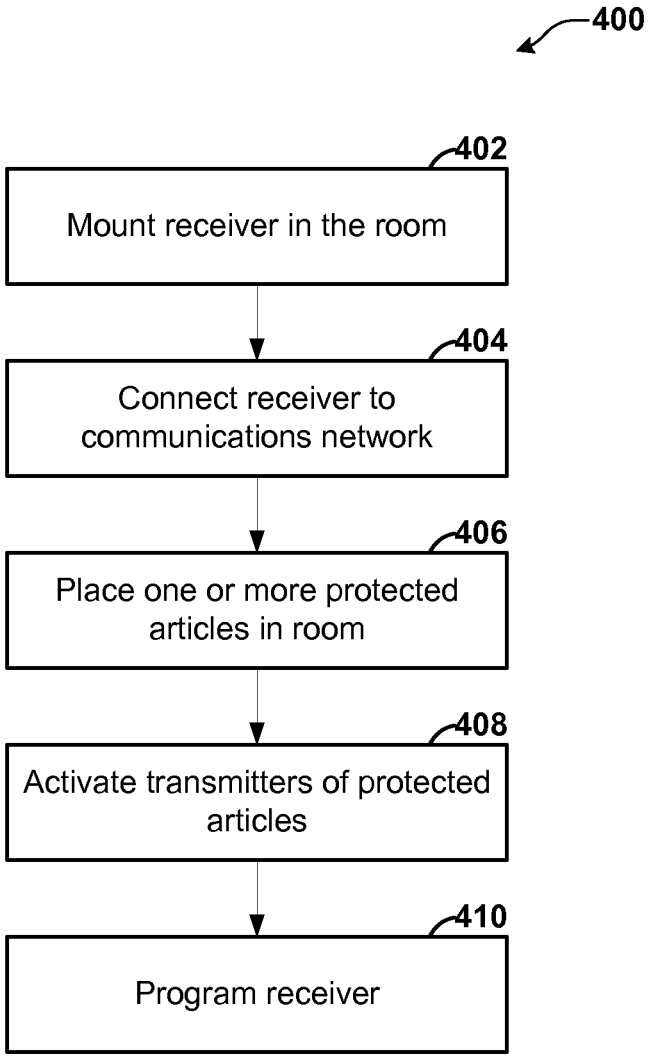
FIG. 4 is a flowchart that illustrates an example operation for installing the loss prevention system.

FIG. 4 is a flowchart illustrating an example operation 400 for installing the loss prevention system 100. As illustrated in the example of FIG. 4, the operation 400 begins when an installer mounts the receiver 110 in the room 104 (402). As discussed above, the installer can mount the receiver 110 in the room 104 in various ways. After the installer mounts the receiver 110 in the room 104, the installer connects the receiver to the communications network 114 (404). In various embodiments, the installer can connect the receiver to the communications network 114 in various ways. For example, the installer can plug a network cable into the receiver 110. In another example, the installer can configure the receiver 110 to use a wireless signal to connect to the communications network 114.

Furthermore, the installer places one or more protected articles (e.g., the protected article 102) in the room 104 (406). Each of the protected articles has a transmitter that emits infrared signals that carry digital signatures. After the installer places the protected articles in the room 104, the installer activates the transmitters of the protected articles (408). In various embodiments, the installer can activate the transmitters in various ways. For example, the installer can activate the transmitters using on/off switches on the transmitters. In another example, the installer can activate the transmitters by installing batteries in the transmitters. In yet another example, the installer can activate the transmitters by connecting the power supplies of the transmitters to main power supplies of the protected articles.

The installer can then program the receiver 110 to perform alarm actions if the receiver 110 does not detect within rolling time windows infrared signals having carrier frequencies that are modulated to encode the digital signatures of the transmitters (410). As discussed above, the receiver 110 can be programmed in various ways.

The various embodiments described above are provided by way of illustration only and should not be construed as limiting. Those skilled in the art will readily recognize various modifications and changes that may be made without following the example embodiments and applications illustrated and described herein. For example, the operations shown in the figures are merely examples. In various embodiments, similar operations can include more or fewer steps than those shown in the figures. Furthermore, in other embodiments, similar operations can include the steps of the operations shown in the figures in different orders.

What is claimed is:

1. A loss prevention system comprising:

a protected article comprising a transmitter that emits an infrared signal, the infrared signal having a carrier frequency that is modulated to encode a digital signature, the protected article being located in a room; and a receiver that detects infrared signals, the receiver mounted at a fixed position within the room, the receiver performing an alarm action if the receiver does not detect within a rolling time window an infrared signal having the carrier frequency that is modulated to encode the digital signature; and a second protected article, the second protected article comprising a second transmitter that emits a second infrared signal, the second infrared signal having a second carrier frequency that is modulated to encode a second digital signature, the second protected article located in the room;

wherein the receiver performs the alarm action if the receiver does not detect within a second rolling time window an infrared signal having the second digital signature.

2. The loss prevention system of claim 1, wherein the receiver draws power from a main power supply of a building that contains the room.

3. The loss prevention system of claim 1, wherein the alarm action comprises emitting an audible alarm.

4. The loss prevention system of claim 1, wherein the alarm action comprises sending an alarm message to an alarm control center.

5. The loss prevention system of claim 4, wherein the receiver sends the alarm message to the alarm control center via a communications network.

6. The loss prevention system of claim 4, wherein the room is in a first building and the alarm control center is in a second building.

7. The loss prevention system of claim 4, wherein a person or computing device at the alarm control center determines how to respond to the alarm message.

8. The loss prevention system of claim 1, wherein after the receiver is mounted in the room, an end user programs the receiver to perform the alarm action if the receiver does not detect within the rolling time window the infrared signal having the carrier frequency that is modulated to encode the digital signature.

9. The loss prevention system of claim 8, wherein the receiver comprises a programming control, wherein after the end user activates the programming control, the receiver detects a set of infrared signals over a given time period and subsequently performs alarm actions when the receiver does not detect infrared signals having digital signatures of the set of infrared signals.

10. The loss prevention system of claim 8, wherein the receiver receives the digital signature from a computing device via a communications network.

11. The loss prevention system of claim 1, wherein the transmitter draws power from a main power supply of the protected article.

12. The loss prevention system of claim 1, wherein the transmitter draws power from a rechargeable battery that is separate from a main power supply.

13. The loss prevention system of claim 1, wherein the transmitter is programmed with the digital signature when the transmitter is manufactured.

14. The loss prevention system of claim 1, wherein the digital signature is a sequence of digits.

15. A method of installing a loss prevention system, the method comprising:

placing a protected article in a room, the protected article comprising a transmitter that emits an infrared signal, the infrared signal having a carrier frequency that is modulated to encode a digital signature;

mounting a receiver in the room, the receiver detecting infrared signals, the receiver mounted at a fixed position within the room, the receiver performing an alarm action if the receiver does not detect within a rolling time window an infrared signal having the carrier frequency that is modulated to encode the digital signature;

placing a second protected article in the room, the second protected article comprising a second transmitter that emits a second infrared signal, the second infrared signal having the carrier frequency, the carrier frequency modulated to encode a second digital signature; and performing by the receiver, the alarm action if the receiver does not detect within a second rolling time window an infrared signal that carries the second digital signature.

16. The method of claim 15, further comprising: after mounting the receiver in the room, programming the receiver to perform the alarm action when the receiver does not detect within the rolling time window the infrared signal having the carrier frequency that is modulated to encode the digital signature.

17. The method of claim 15, wherein the method further comprises connecting the receiver to a communications network; and wherein the alarm action comprises sending an alarm message to an alarm control center via the communications network.

18. A method of installing a loss prevention system, the method comprising:

placing a protected article in a room, the protected article comprising a transmitter that emits an infrared signal, the infrared signal having a carrier frequency that is modulated to encode a digital signature;

mounting a receiver in the room, the receiver detecting infrared signals, the receiver mounted at a fixed position within the room, the receiver performing an alarm action if the receiver does not detect within a rolling time window an infrared signal having the carrier frequency that is modulated to encode the digital signature;

after mounting the receiver in the room, programming the receiver to perform the alarm action when the receiver does not detect within the rolling time window the infrared signal having the carrier frequency that is modulated to encode the digital signature;

placing a second protected article in the room, the second protected article comprising a second transmitter that emits a second infrared signal, the second infrared signal having the carrier frequency, the carrier frequency modulated to encode a second digital signature, wherein the receiver performs the alarm action if the receiver does not detect within a second rolling time window an infrared signal that carries the second digital signature;

connecting the receiver to a communications network; and sending an alarm message to an alarm control center via the communications network.

* * * * *